United States Patent [19]

Kusama et al.

[11] Patent Number: 4,585,161

[45] Date of Patent: Apr. 29, 1986

[54] AIR FUEL RATIO CONTROL SYSTEM FOR FURNACE

[75] Inventors: Akio Kusama, Tokyo; Ichiro Nakamachi, Abiko; Kunio Shigihara, Fuchu; Hiroyuki Amemori, Kawasaki; Yasuji Miyata; Tetsuo Iwamoto, both of Yokohama, all of Japan

[73] Assignees: Tokyo Gas Company Ltd.; Tokico Ltd., ; JPX

[21] Appl. No.: 712,898

[22] Filed: Mar. 18, 1985

[30] Foreign Application Priority Data

Apr. 27, 1984 [JP] Japan ..... 59-62414[U]
Sep. 19, 1984 [JP] Japan ..... 59-194583
Sep. 19, 1984 [JP] Japan ..... 59-194584

[51] Int. Cl.[4] ..... F23N 1/00

[52] U.S. Cl. ..... 236/15 BD; 137/101.19; 431/12

[58] Field of Search ..... 236/15 BD, 15 E, 1 EA; 431/12, 76, 89, 90; 137/100, 101.19, 101.21, 89, 88, 599

[56] References Cited

U.S. PATENT DOCUMENTS 3,076,605 2/1963 Holden ..... 236/15 BG
3,137,341 6/1964 Ruffing ..... 236/15 BD X
3,722,811 3/1973 Osburn ..... 236/15 E X
4,406,611 9/1983 Michel ..... 236/15 BD X
4,421,473 12/1983 Londerville ..... 236/15 BD X

FOREIGN PATENT DOCUMENTS 0190618 11/1983 Japan ..... 236/15 BD

*Primary Examiner*—Harry Tanner
*Attorney, Agent, or Firm*—Andrus, Sceales, Starke & Sawall

[57] ABSTRACT

An air fuel ratio control system comprises a first valve provided in a fuel pipe through which a fuel is supplied to a burner, a second valve provided in an air pipe through which air is supplied to the burner, a varying circuit for varying responsive to a preset flow rate of fuel a valve opening degree of each of the first and second valves while maintaining a constant ratio between the valve opening degrees of the first and second valves, so that an air fuel ratio of a flow rate of fuel flowing through the first valve and a flow rate of air flowing through the second valve assumes a value greater than a theoretical air fuel ratio, a first sensor for detecting a flow rate of fuel flowing through the fuel pipe, a second sensor for detecting a flow rate of air flowing through the air pipe, a fuel bypass pipe provided in the fuel pipe for bypassing the first valve, a third valve provided in the fuel bypass pipe, and a control circuit supplied with output signals of the first and second sensors for controlling a valve opening ratio of the third valve, so that the air fuel ratio assumes a predetermined air fuel ratio.

8 Claims, 6 Drawing Figures

AIR FUEL RATIO CONTROL SYSTEM FOR FURNACE

BACKGROUND OF THE INVENTION

The present invention generally relates to air fuel ratio control systems, and more particularly to an air fuel ratio control system suitable for reducing energy consumption in the combustion of a furnace.

A conventional air fuel ratio control system used in a combustion control system of a gas furnace is designed to maintain a constant air fuel ratio (a mixing ratio of air and fuel gas) by controlling a valve opening degree (a degree to which a valve is opened) of a control valve provided in a gas supplying pipe and a valve opening degree of a control valve provided in an air supplying pipe to become constant.

The relationship between a valve opening degree of a control valve and a flow rate through the control valve is not perfectly proportional to each other, and has non-linearity and hysteresis characteristics. Further, the control valves used in the above mentioned air fuel ratio control system are relatively large and have a large hysteresis. Therefore, it is difficult to control the air fuel ratio constant even when the valve-opening degree of each control valve is maintained constant. For this reason, the control valves are controlled to obtain such an air fuel ratio that the flow rate of air is slightly in excess with respect to the flow rate of fuel gas compared to a preset air fuel ratio in order to avoid incomplete combustion even when the air fuel ratio changes in a direction in which the quantity of air decreases. In other words, when an air ratio is described by a ratio of the actual flow rate of air and the theoretical flow rate of air, the control valves are controlled so that the air ratio assumes a valve in a range of approximately 1.2–1.4. Thus, the combustion system is operated with such an air fuel ratio that the flow rate of air is slightly in excess even when the flow rate of air decreases in a fluctuating range. However, the thermal efficiency of the furnace is inevitably decreased due to the excess air supplied to the furnace, and problems are introduced when attempts are made to reduce the energy consumption of the furnace.

In addition, according to some furnaces, it is preferable to set the air fuel ratio to an air fuel ratio in which the flow rate of air is slightly in excess or deficient compared to the air fuel ratio for the ideal combustion efficiency, as the load of the furnace decreases. For example, the fuel and the air velocities in the burner decreases as the load of the furnace decreases. As a result, an incomplete mixing tends to occur when the load of the furnace is small. For this reason, in order to ensure complete combustion, the air fuel ratio must be controlled so that the flow rate of air is slightly in excess as the load of the furnace decreases. In the case of a furnace which is not sufficiently air-tight, such as a continuous furnace, the pressure within the furnace deviates to the negative pressure side as the load of the furnace decreases. In this case, even when the fuel and air are supplied from the burner, with a constant air fuel ratio the air in the furnace is extremely in excess in most cases due to the air which enters from the outside. In this case, it is desirable in some furnaces to control the air fuel ratio on the burner side to obtain a air fuel ratio in which the flow rate of fuel becomes in excess as the load decreases, so that overall air fuel ratio within the furnace assumes an appropriate value with regard to the combustion efficiency.

In the conventional air fuel ratio control systems, however, it is impossible to control the air fuel ratio in the manner described above. Therefore, the conventional air fuel ratio control systems suffer problems in that the systems cannot be generally applied to furnaces having different requirements.

SUMMARY OF THE INVENTION

Accordingly, it is a general object of the present invention to provide a novel and useful air fuel ratio control system in which the problems described heretofore are eliminated.

Another and more specific object of the present invention is to provide an air fuel ratio control system for obtaining a desired air fuel ratio, which system comprises control valves controlled to a constant valve opening degree in a gas supplying pipe and an air supplying pipe, respectively, a bypass pipe provided in the gas supplying pipe for bypassing the control valve, and a compact auxiliary control valve provided in the bypass pipe for controlling a part of an air fuel ratio which cannot be controlled by the control valves.

Still another object of the present invention is to provide an air fuel ratio control system having such a construction that it is possible to obtain an theoretical air fuel ratio with regard to the combustion efficiency, or an air fuel ratio which is ideal to a furnace which is applied with the control system of the present invention.

Other objects and further features of the present invention will be apparent from the following detailed description when read in conjunction with the accompanying drawings.

DETAILED DESCRIPTION

Figure 1:
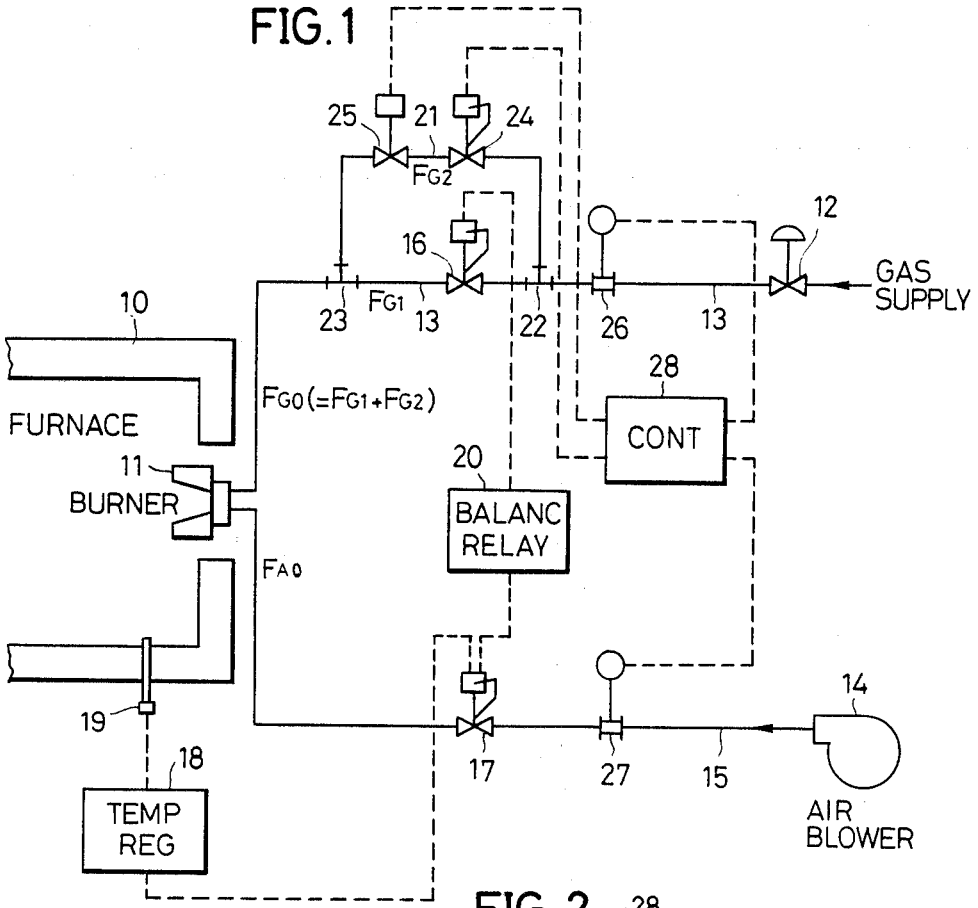
FIG. 1 is a systematic block diagram generally showing a first embodiment of the air fuel ratio control system of the present invention.

In FIG. 1, an industrial gas furnace 10 is provided with a burner 11. The burner 11 is supplied with a fuel gas from a gas source through a governor 12 and a gas supplying pipe 13. In the governor 12 the gas is regulated to a constant pressure. Air is supplied to the burner 11 from a blower 14 through an air-supplying pipe 15. Combustion of the gas takes place in the furnace 10.

The pipes 13 and 15 are respectively provided with a main control valve 16 for gas and a control valve 17 for air. The control valve 17 is operated in response to an output of a temperature regulator 18 which regulates the temperature within the furnace 10, and is changed of a valve opening degree thereof. The temperature regulator 18 is supplied with a temperature signal from a thermocouple 19 provided inside the furnace 10.

The valve opening degree of the control valve 16 is controlled in proportion to the valve opening degree of the control valve 17 by means of a balancing relay 20. The control valves 16 and 17 are therefore controlled in an interrelated manner so that the ratio of the valve opening degrees of the valves are maintained constant.

A gas bypass pipe 21 is connected to the gas supplying pipe 13 by branching pipes 22 and 23. Thus, the bypass pipe 21 bypasses the control valve 16. The bypass pipe 21 is provided with an auxiliary control valve 24 and a shut-off valve 25.

The pipe 13 is provided with a flow rate sensor 26 for detecting the flow rate of gas. The pipe 15 is provided with a flow rate sensor 27 for detecting the flow rate of air. The flow rate signals from the flow rate sensors 26 and 27 are respectively applied to a controller 28. A theoretical air fuel ratio Ma with regard to the combustion efficiency of the gas subjected to the combustion in the furnace 10, is pre-stored in the controller 28. The controller 28 controls the valve opening degree of the auxiliary control valve 24 so that an amount of gas which is deficient is additionally supplied through the gas bypass pipe 21. The controller 28 also shuts off the shut-off valve 25 when an abnormal incident occurs.

The flow rate of gas is distributed in the gas supplying system so that seventy to eighty percent of the total quantity of gas in the gas supplying system flows through the control valve 16 and thirty to twenty percent of the total quantity of gas flows through the auxiliary control valve 24.

Figure 2:
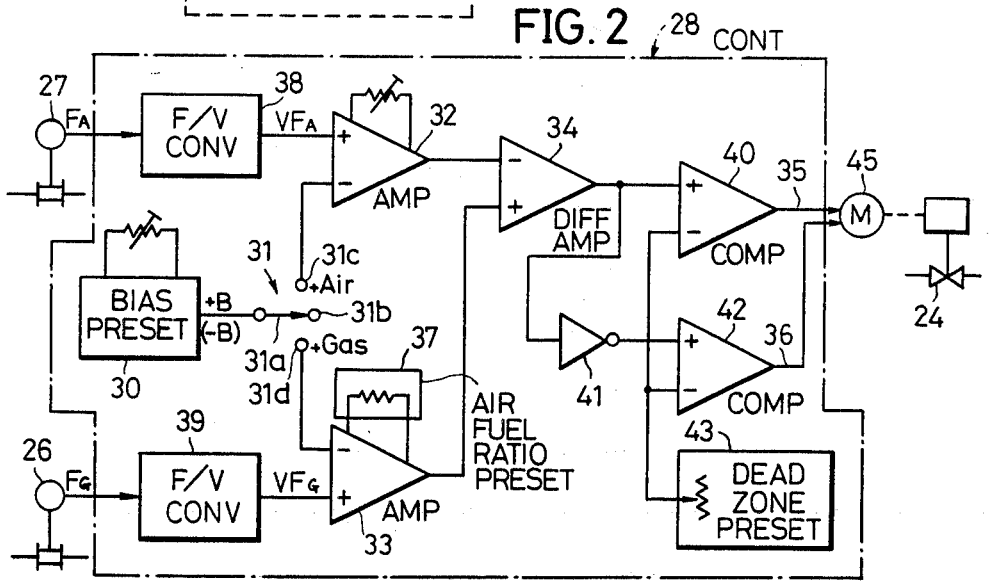
FIG. 2 is a block diagram showing a circuit within an essential part of a controller shown in FIG. 1.

Next, the construction and operation of the controller 28 will be explained. In FIG. 2, a bias presetting circuit 30 presets a bias quantity +B or −B. On the output side of the bias presetting circuit 30, there is provided a switch 31 which selectively connects a contact segment 31*a* to a neutral contact point 31*b*, a contact point 31*c* or a contact point 31*d*. The contact point 31*c* is connected to an inverting input terminal of an amplifier 32 which has a gain $G_A$. The contact point 31*d* is connected to an inverting input terminal of an amplifier 33 which has a gain $G_G$. Output terminals of the amplifiers 32 and 33 are connected to an inverting input terminal and a non-inverting input terminal of a differential amplifier 34, respectively. Depending on the output state of the differential amplifier 34, a valve-closing signal is transmitted through a line 35 or a valve-opening signal is transmitted through a line 36 so as to control the auxiliary control valve 24, as will be described later. An air fuel ratio presetting circuit 37 for presetting the theoretical air fuel ratio Ma with regard to the combustion efficiency is coupled to the amplifier 33. The air fuel ratio presetting circuit 37 indirectly presets the air fuel ratio by setting the gain of the amplifier 33 to a gain $G_G$.

An output signal of the flow rate sensor 27 is supplied to a frequency-to-voltage (F/V) converter 38 wherein the output signal of the flow rate sensor 27 is converted into a voltage $VF_A$, and is supplied to a non-inverting terminal of the amplifier 32. An output signal of the flow rate sensor 26 is supplied to a F/V converter 39 wherein the output signal of the flow rate sensor 26 is converted into a voltage $VF_G$, and is supplied to a non-inverting input terminal of the amplifier 33.

The output terminal of the differential amplifier 34 is connected to a non-inverting input terminal of a comparator 40, and to a non-inverting input terminal of a comparator 42 through an inverter 41. A dead zone presetting circuit 43 which presets the width of the dead zone is connected to inverting input terminals of the comparators 40 and 42.

It will be assumed that the flow rate of air and the flow rate of gas are respectively represented by $F_A$ and $F_G$, and the air fuel ratio is represented by $F_A/F_G$. It will be assumed that the air fuel ratio ($F_A/F_G$) is equal to Ma which is the theoretical air fuel ratio with regard to the combustion efficiency, in a case where the flow rate of gas and the flow rate of air are respectively represented by $F_{G0}$ ($=F_{G1}+G_{G2}$) and $F_{A0}$, where $F_{G1}$ represents the flow rate of gas through the control valve 17 and $F_{G2}$ represents the flow rate of gas through the auxiliary valve 24.

Figure 4:
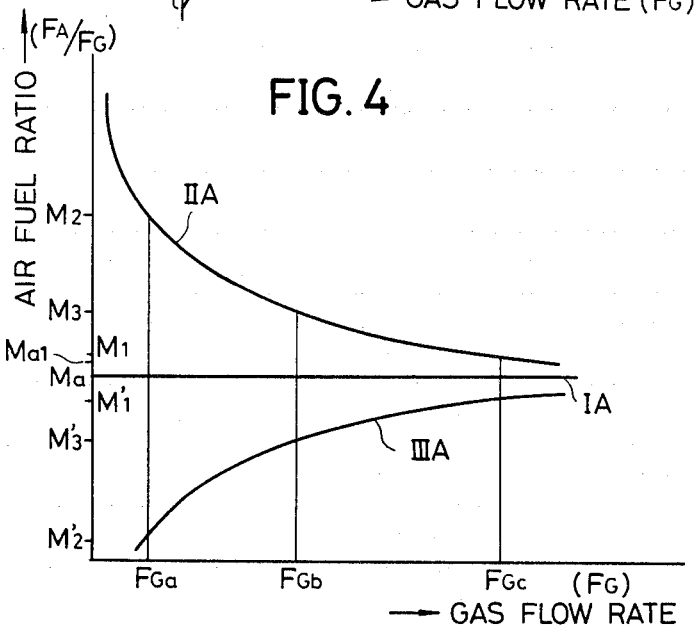
FIG. 4 is a graph showing the relationship between the air fuel ratio and the flow rate of gas for the three different cases in which the system in FIG. 1 is used.

The ratio of the valve opening degrees of the control valves 16 and 17 which are controlled in the interrelated manner so that a constant ratio of the valve opening degrees is maintained, is determined so that a flow rate $F_{G1}$ of gas is supplied through the control valve 16 and a flow rate $F_{A0}$ of air is supplied through the control valve 17. That is, the ratio of the valve opening degrees is determined so that the air fuel ratio becomes equal to $F_{A0}/F_{G1}$ which is represented in FIG. 4 as an air fuel ratio $Ma_1$. As can be seen from FIG. 4, the air fuel ratio $Ma_1$ is located on the slightly air-excess side.

Next, descriptions will be given with respect to the control of the air fuel ratio for each usage of the furnace 10 to which the air fuel control system of the present invention is applied.

Case (A): In a case where the furnace 10 is an ordinary combustion furnace, the air fuel ratio is selected equal to the theoretical air fuel ratio with regard to the combustion efficiency. Hence, the valve opening degree of the auxiliary control valve 24 is controlled so that a flow rate $F_{G2}$ of gas flows through the bypass pipe 21.

In FIG. 2, the contact segment 31*a* of the switch 31 is connected to the neutral contact point 31*b*. The flow rate sensors 26 and 27 respectively detect a flow rate $F_{G0}$ of gas and a flow rate $F_{A0}$ of air. The characteristics of the amplifiers 32 and 33 and the differential amplifier 34 are selected so that a deviation voltage D which is the output of the differential amplifier 32 becomes zero in a case where the output of the amplifier 33 is given by $VF_{G0}\times G_G$, and the output of the amplifier 32 is given by $VF_{A0}\times G_A$. $VF_{G0}$ represents an input voltage of the amplifier 33 when the flow rate of gas is equal to $F_{G0}$, and $VF_{A0}$ represents an input voltage of the amplifier 32 when the flow rate of air is equal to $F_{A0}$.

Thus, when the output voltage D of the differential amplifier 32 is zero, the following equation (1) stands.

$$VF_{A0}\times G_A=VF_{G0}\times G_G \quad (1)$$

Equation (1) can be rewritten as the following equation (2).

$$VF_{A0}=(G_G/G_A)\times VF_{G0} \quad (2)$$

Figure 3:
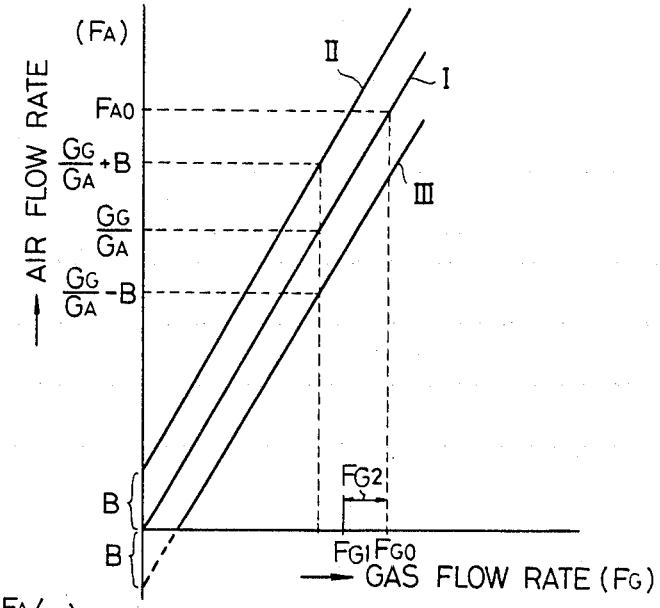
FIG. 3 is a graph showing the relationship between the flow rate of air and the flow rate of gas for three different cases in which the system in FIG. 1 is used.

This relation is indicated by a line I in FIG. 3. Since the flow rate and the voltage correspond to each other, the abscissa in FIG. 3 represents the flow rate $F_G$ of gas and the ordinate represents the flow rate $F_A$ of air, for convenience' sake.

When it is assumed that the auxiliary control valve 24 is closed, the measured flow rate of gas is represented by $F_{G1}$ ($<F_{G0}$) and the measured flow rate of air is represented by $F_{A0}'$ an intersection of the measured flow rate $F_{G1}$ of gas and the measured flow rate $F_{A0}$ of air is located on the left of the line I in FIG. 3. In this case, the differential amplifier 34 produces a negative deviation voltage $-D$. This voltage $-D$ is applied to a non-inverting input terminal of the comparator 40, and to a non-inverting input terminal of the comparator 42 through the inverter 41. Each of the comparators 40 and 42 compares the deviation voltage applied to the non-inverting input terminal thereof with a voltage $V_{Ha}$ which is present in correspondence with a dead zone W and is obtained from the dead zone presetting circuit 43. In the present case, the comparator 42 produces a valve opening signal, and the motor 45 is rotated in a forward direction and the auxiliary control valve 24 is actuated by the motor 45 to open. Thus, the gas starts to flow through the bypass pipe 21. As the flow rate of gas through the bypass pipe 21 increases and reaches a value $F_{G2}$, the measured flow rate of gas becomes equal to $F_{G0}$ and the intersection of the measured flow rate of gas and the measured flow rate of air moves onto the line I in FIG. 3. As a result, the deviation voltage from the differential amplifier 34 becomes zero. Accordingly, no signal is obtained from the comparator 42, and the control valve 24 stops opening further at the valve opening degree which permits the gas to flow through the auxiliary control valve 24 with the flow rate of $F_{G2}$.

Therefore, a point which represents the air fuel ratio $F_A/F_G$ of the gas and air supplied to the burner 11, coincides with a line II in FIG. 4 representing the theoretical air fuel ratio Ma.

When the measured flow rate of gas increases above the preset flow rate $F_G$ of the measured flow rate of air decreases due to external disturbances or the like, the air fuel ratio deviates from the theoretical air fuel ratio Ma and the differential amplifier 34 produces a positive deviation voltage $+D$. This deviation voltage $+D$ is applied to the non-inverting input terminal of the comparator 40, and also to the non-inverting input terminal of the comparator 42 through the inverter 41. When the deviation voltage $+D$ becomes greater than the voltage $V_{Ha}$ from the dead zone presetting circuit 43, that is when $+D>V_{Ha}$, a valve closing signal is produced from the comparator 40. The motor 45 is thus rotated in a reverse direction, and the auxiliary control valve 24 is actuated so as to close. Accordingly, the flow rate of fuel through the bypass pipe 21 decreases, and the flow rate of air relatively increases. The air fuel ratio $F_A/F_G$ returns to the theoretical air fuel ratio Ma.

On the contrary, when the measured flow rate of gas decreases or the measured flow rate of air increases, the differential amplifier 34 produces the negative deviation voltage $-D$. When the decrease in the measured flow rate of gas or the increase in the measured flow rate of air exceeds a predetermined value and a relation $-D>V_{Ha}$ stands, the comparator 42 produces a valve opening signal and the auxiliary control valve 24 is actuated in a direction to open. Hence, the flow rate of fuel through the bypass pipe 21 increases, the flow rate of air relatively decreases, and the air fuel ratio $F_A/F_G$ returns to the theoretical air fuel ratio Ma.

In the case described heretofore, the furnace 10 is operated with the theoretical air fuel ratio with regard to the combustion efficiency throughout the entire flow rate range of gas as indicated by the line IA in FIG. 4. Further, since the theoretical air fuel ratio is obtained by controlling the auxiliary control valve 24 which is provided in the bypass pipe 21 which receives approximately 20 to 30 percent of the total flow rate of gas, it is possible to accurately control the air fuel ratio. In actual practice, the air ratio can be improved to approximately 1.1. When the air ratio is improved from 1.26 to 1.1 by the present invention, approximately 20 percent of the gas can be saved in the furnace which is operated at an exhaust temperature of 1180° C.

Case (B): In the case where the air fuel ratio is selected to an air fuel ratio in which there is slight excess of air as the load decreases, the contact segment 31*a* of the switch 31 shown in FIG. 2 is switched and connected to the contact point 31*c*. Hence, the output of the amplifier 32 assumes a value $(VF_A-B)\times G_A$. The equation (1) described before takes the form of the following equation (1A).

$$(VF_A-B)\times G_A=VF_G\times G_G \quad (1A)$$

Equation (1A) can be rewritten as the following equation (2A).

$$VF_A=(G_G/G_A)\times VF_G+B \quad (2A)$$

This relation is shown in FIG. 3 as the line II. As can be seen from FIG. 3, the flow rate $F_A$ of air is always larger than the case (A) described before by an amount which corresponds to the bias quantity B, regardless of the flow rate $F_G$ of fuel.

The above equation (1A) can also be rewritten in the form of the following equation (3A) in terms of the air fuel ratio $F_A/F_G$ and the flow rate $F_G$ of fuel.

$$F_A/F_G=G_G/G_A+B/F_G \quad (3A)$$

This relation is shown in FIG. 4 by a curve IIA.

When the flow rate of gas or the flow rate of air changes, a signal is transmitted through the line 35 or 36 in a manner similar to that described previously and the auxiliary control valve 24 is actuated by this signal so that the air fuel ratio is controlled to coincide with the curve IIA.

That is, the air fuel ratio assumes a value larger than the theoretical air fuel ratio Ma with regard to the combustion efficiency throughout the entire flow rate range of gas. Furthermore, the deviation of the air fuel ratio from the theoretical air fuel ratio Ma is large when the flow rate of gas is small and decreases non-linearly as the flow rate of gas increases.

In this way, an optimum air fuel ratio for the above mentioned furnace is obtained.

Since the air fuel ratio has the non-linear characteristic described above, the setting and the control of the air fuel ratio can be performed to match the characteristic of the above mentioned furnace. That is, the flow rate of fuel is set to a large value when the furnace is in a temperature raising step and the load is high. In this case, the air fuel ratio assumes a value which is near the theoretical air fuel ratio Ma, and an efficient combustion takes place in the furnace. When the furnace is heated up to a desired temperature, the control valves 16 and 17 are interrelatedly actuated in the valve-closing direction, and the flow rate of fuel is set to a small value. In this case, the air fuel ratio assumes a value which is departed from the theoretical air fuel ratio Ma, and a considerably excess amount of air exists in the furnace. Thus, an optimum combustion for the characteristic of the furnace can be performed.

Case (C): In the case where the air fuel ratio is selected to an air fuel ratio in which there is slight excess of fuel gas as the load decreases, the bias setting circuit 30 in FIG. 2 is manipulated so that the bias quantity becomes equal to $-B$, and the switch 31 is connected to the contact point 31*c*. Hence, the output of the amplifier 32 becomes equal to $(VF_A+B)\times G_A$. The above mentioned equation (1A) can be rewritten in the form of the following equation (1B).

$$(VF_A+B)\times G_A=VF_G\times G_G \quad (1B)$$

Equation (1B) can also be rewritten as the following equation (2B).

$$VF_A=(G_G/G_G)\times VF_G-B \quad (2B)$$

This relation is represented in FIG. 3 by a line III. As can be seen from FIG. 3, the flow rate $F_A$ of air is always smaller compared to the case (A) described before by an amount which corresponds to the bias quantity $-B$, regardless of the flow rate $F_G$ of fuel.

The above equation (1B) can also be described in terms of the air fuel ratio $F_A/F_G$ and the flow rate $F_G$ of fuel as shown in the following equation (3B).

$$F_A/F_G=G_G/G_A-B/F_G \quad (3B)$$

This relation is represented in FIG. 4 by a curve IIIA.

When the flow rate of gas or the flow rate of air changes, a signal is transmitted through the line 35 or 36, and the auxiliary control valve 24 is actuated by this signal. The air fuel ratio is controlled so as to coincide with the curve IIIA.

Therefore, the air fuel ratio assumes smaller value than the theoretical air fuel ratio Ma with regard to the combustion efficiency throughout the entire flow rate range of gas. Further, the deviation of the air fuel ratio from the theoretical air fuel ratio Ma is large when the flow rate of gas is small, and decreases non-linearly as the flow rate of gas increases.

Thus, an optimum air fuel ratio for the above mentioned furnace can be obtained.

In addition, the air fuel ratio is controlled in response to the flow rate of fuel, approximately in the same manner as the above mentioned case (B). That is, the flow rate of fuel is set to a large value when the furnace is in the temperature raising step and the load is high. In this case, the air fuel ratio assumes a value which is near the theoretical air fuel ratio Ma so that an efficient combustion takes place in the furnace. When the furnace is heated to a desired temperature, the valves 16 and 17 are interrelatedly actuated to the valve-closing direction, and the fuel-flow rate is set to a small value. Thus, the air fuel ratio assumes a value which is departed from the theoretical air fuel ratio Ma, so that a considerably excess amount of gas exists in the furnace. In this way, an optimum combustion for characteristic of the furnace is performed.

In the above mentioned cases (B) and (C), it is also possible to supply excess fuel or excess air (deficient fuel) when the load is small by switching and connecting the switch 31 to the contact point 31*d*, so as to connect the bias presetting circuit 30 to the inverting input terminal of the amplifier 33 which is provided in the fuel system. That is, in the case where the bias quantity B of the bias presetting circuit 30 is selected to a positive value, a predetermined quantity of fuel which corresponds to the bias quantity B is additionally supplied. Thus, the air fuel ratio assumes an air fuel ratio in which there is slight excess fuel as the load decreases. On the other hand, in the case where the bias quantity B is selected to a negative value, a predetermined quantity of fuel which corresponds to the bias quantity B is deficient. Thus, the air fuel ratio assumes an air fuel ratio in which there is slight deficiency of fuel (excess of air) as the load decreases.

Since the bias quantity B of the bias presetting circuit 30 is usually selected to one of the positive and negative voltages, the states in which there are excessive air and excessive fuel are selectively obtained by the switching of the switch 31 in the case where the bias quantity B assumes the positive voltage, and the states in which there are deficient air and deficient fuel are selectively obtained by the switching of the switch 31 in the case where the bias quantity B assumes the negative voltage.

When an abnormality occurs and no flow rate signal is produced from the flow rate sensor 26, the controller 28 shown in FIG. 1 produces a valve closing signal to close the shut-off valve 25 and cut off the supply of gas through the bypass pipe 21. Accordingly, the possibility of incomplete combustion due to the excess supply of gas is positively prevented. In this case, the burner 11 is supplied with the flow rate $F_{G1}$ of gas from the control valve 16 and the flow rate $F_{A1}$ of air from the control valve 17. Hence, the air fuel ratio assumes a value $Ma_1$ in which there is slight excess of air.

In this way, a dangerous situation due to the incomplete combustion of the gas is positively prevented even when at least one of the flow rate sensor 26 and the flow rate sensor 27 breaks down, and the gas burns completely. Accordingly, it is unnecessary to stop operating the furnace 10 even when the above mentioned break down occurs, and the safe operation of the furnace 10 can be continued. Thus, the embodiment is advantageous also from the point of view of the operation efficiency.

It is obvious that the present invention is not limited to the case where the fuel is a gas, and that the present invention is similarly applicable to a case where the fuel is a liquid.

In the above mentioned embodiment, the air fuel ratio control system is provided with the bias presetting circuit 30 and the switch 31 so that the system is applicable to various kinds of furnaces. However, when the system is used exclusively for the furnace of the above mentioned case (A), the bias presetting circuit 30 and the switch 31 can be omitted.

Figure 5:
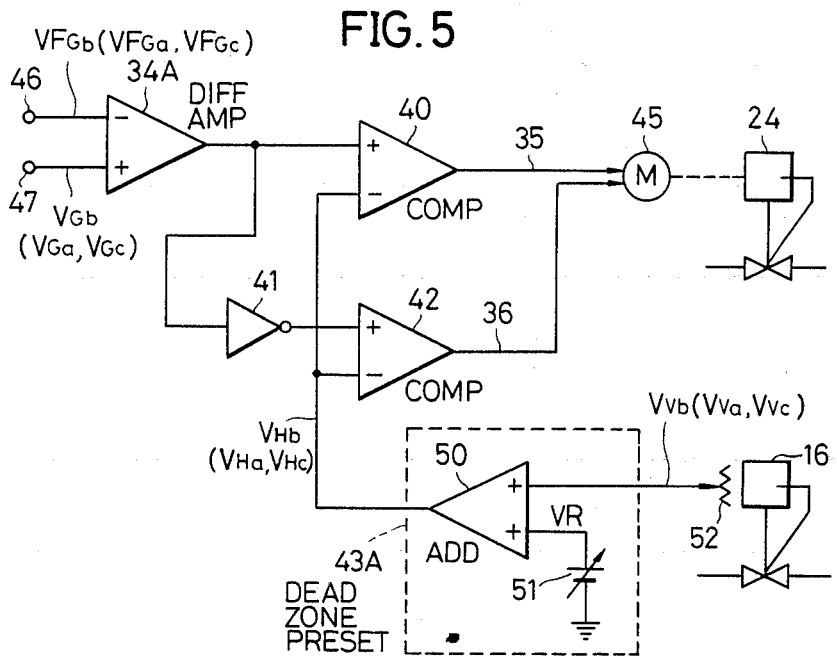
FIG. 5 is a circuit diagram showing an essential part of a modification of the controller shown in FIG. 1.
Figure 6:
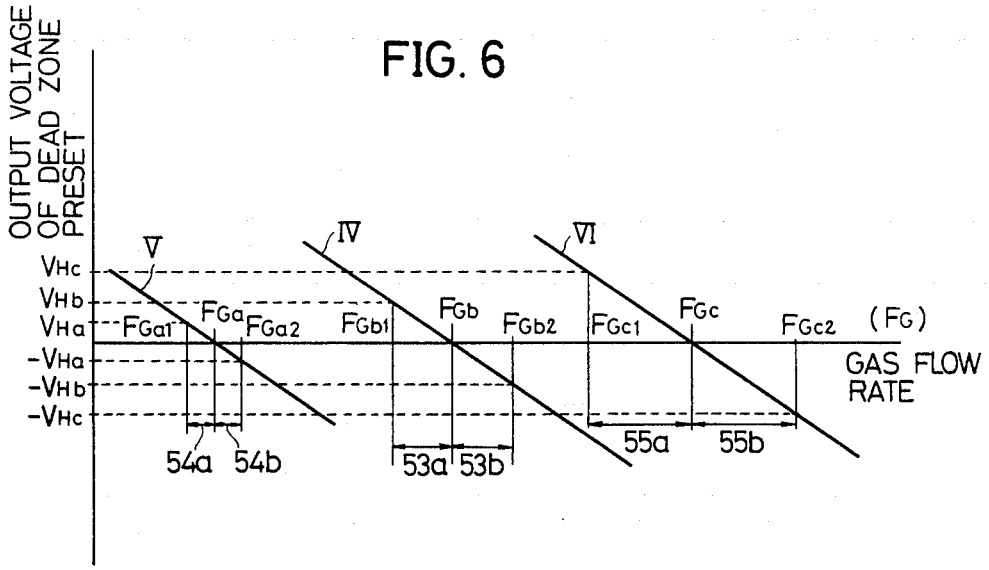
FIG. 6 is a diagram for explaining the change of dead zone in relation to the flow rate of gas.

Next, another embodiment of the temperature regulator 18 will be described by referring to FIGS. 5 and 6. FIG. 5 shows a dead zone presetting circuit 43A with the associated parts thereof. In FIG. 5, those parts which are the same as those corresponding parts in FIG. 2 are designated by the same reference numerals, and their description will be omitted. The dead zone presetting circuit 43A is designed to vary the width of the dead zone in response to the flow rate of gas.

The dead zone presetting circuit 43A comprises an adder 50 and a power source 51. The adder 50 adds a voltage $V_R$ from the power source 51 and a voltage $V_V$ from a potentiometer 52 which is provided on the control valve 16 and produces a voltage proportional to the valve opening degree of the control valve 16. The adder 50 produces a voltage $V_H(=K_1\cdot V_V+K_2\cdot V_R$, where $K_1$ and $K_2$ are positive constants). This voltage $V_H$ determines the width of a non-corrected flow rate region as will be described later.

It will be assumed that the flow rate of gas is set to $F_{Gb}$ (see FIG. 4). The control valve 16 is open to a predetermined valve opening degree and the potentiometer 52 produces the voltage $V_V$ which is applied to the adder 50. The flow rate sensor 26 detects a flow rate $F_{Gb}$ and a measured flow rate voltage $V_{Gb}$ is applied to an inverting input terminal of a differential amplifier 34A.

When the flow rate in the pipe 13 changes due to the external disturbance or the like, the voltage $V_{Gb}$ also changes. The differential amplifier 34A produces a deviation voltage D which is proportional to the difference between the measured flow rate voltage $V_{Gb}$ and a flow rate preset voltage $V_{Gb}$ which is a reference signal. The correspondence of the output of the differential amplifier 34A and the change in the flow rate is shown in FIG. 6 by a line IV. That is, when the measured flow rate is equal to the preset flow rate $F_{Gb}$ the output voltage of the differential amplifier 34A is zero. When the measured flow rate drops below the flow rate $F_{Gb}$, the differential amplifier 34A produces a positive output voltage. On the other hand, when the measured flow rate exceeds the flow rate $F_{Gb}$, the differential amplifier 34A produces a negative output voltage.

The adder 50 is supplied with the voltage $V_R$ from the power source 51 and the voltage $V_{Vb}$ from the potentiometer 52 and produces a voltage $V_{Hb}$.

In a case where the deviation of the measured flow rate from the flow rate $F_{Gb}$ in the decreasing direction is small and the relation $D<V_{Hb}$ stands, the comparator 40 does not produce a signal. The comparator 42 also does not produce a signal, since the relation $-D<-V_{Hb}$ stands. Therefore, the auxiliary control valve 24 is maintained at the same valve opening degree. When the above mentioned deviation increases and the relation $D>V_{Hb}$ stands, a valve opening signal is produced from the comparator 40 and the motor 45 is rotated in the forward direction to open the valve 24. Thus, the flow rate increases and controlled to approach the flow rate $F_{Gb}$. On the other hand, in a case where the measured flow rate changes to a direction to exceed flow rate $F_{Gb}$, the output voltage D of the differential amplifier 34A assumes a negative value. In the case of where the relation $-D<V_{Hb}$ stands in the comparator 40 and the relation $+D<V_{Hb}$ stands in the comparator 42, the comparators 40 and 42 do not produce a signal and the valve 24 remains at the same valve opening degree. When the deviation of the measured flow rate with respect to the flow rate $F_{Gb}$ increases and the relation $+D>V_{Hb}$ stands, the valve closing signal is produced from the comparator 42 and the motor 45 is rotated in the reverse direction. The valve 24 is actuated to the closing direction and the flow rate decreases. The flow rate is controlled so as to approach the flow rate $F_{Gb}$.

That is, in the case where the flow rate is preset to $F_{Gb}$, the valve 24 is not actuated and remains in the same state when the measured flow rate falls in the range between a flow rate $F_{Gb1}$ which is determined by the voltage $V_{Hb}$ and a flow rate $F_{Gb2}$ which is determined by the voltage $-V_{Hb}$. When the measured flow rate exceeds the flow rate $F_{Gb1}$ or $F_{Gb2}$, the valve 24 is actuated to correct the flow rate, and the flow rate is controlled to fall in the range between the flow rates $F_{Gb1}$ and $F_{Gb2}$. A region 53*a* defined by the flow rates $F_{Gb}$ and $F_{Gb1}$ and a region 53*b* defined by the flow rates $F_{Gb}$ and $F_{Gb2}$ respectively are the dead zones in which the controller 28 does not actuate the auxiliary valve 24. In other words, the dead zone is the non-corrected flow rate region in which the flow rate is not corrected.

When the flow rate is set to $F_{Ga}$ which is smaller than the flow rate $F_{Gb}$, the corresponding flow rate preset voltage assumes a value $V_{Ga}$, and the control valve 16 is slightly closed to assume a valve opening degree which corresponds to the flow rate $F_{Ga}$. Thus, the pipe system assumes a state in which there is a flow of the flow rate of $F_{Ga}$, and a voltage corresponding to the measured flow rate becomes equal to $VF_{Gb}$. Also, due to the change in the valve opening degree of the valve 16 in a direction the valve opening degree decreases, the output voltage of the potentiometer 52 decreases to a value $V_{V1}$ and the output voltage of the adder 50 decreases to a value $V_{Ha}$ (<VHb). Further, the relation between the output of the differential amplifier 34A and the flow rate is shown in FIG. 6 by a line V.

In the case where the measured flow rate changes about the flow rate $F_{Ga}$, the valve 24 is not actuated and remains in the same state as long as the flow rate remains within the rang defined by flow rates $F_{Ga1}$ and $F_{Ga2}$ which are respectively determined by the voltages $V_{Ha}$ and $-V_{Ha}$. When the flow rate decreases below the flow rate $F_{Ga1}$ or increases above the flow rate $F_{Ga2}$, a signal is produced from the comparator 40 or 52 to actuate the valve 24 to correct the flow rate, and the flow rate is controlled to remain within the range between the flow rates $F_{Ga1}$ and $F_{Ga2}$. In this case, non-corrected flow rate regions 54*a* and 54*b* have smaller width compared to the above mentioned non-corrected flow regions 53*a* and 53*b*, and thus, the flow rate is controlled with a higher precision. Also, in the case where the flow rate is small, the range of variation of the flow rate is also small, and there is no hunting problem even when the width of the non-corrected flow rate region is narrowed.

On the other hand, in the case where the flow rate is preset to a value $F_{GC}$ which is larger than the flow rate $F_{Gb}$, the flow rate preset voltage becomes equal to $V_{GC}$ and the valve 16 is opened slightly to assume a valve opening degree which corresponds to the flow rate $F_{GC}$. Thus, a flow of a flow rate $F_{GC}$ exists in the pipe system, and a voltage corresponding to the measured flow rate becomes equal to $VF_{GC}$. In response to the increase of the valve opening degree of the valve 16, the output voltage of the potentiometer 52 increases to $V_{VC}$, and the output of the adder 50 increases to $V_{HC}$ ($>V_{Hb}$). The relation between the output of the differential amplifier 34A and the flow rate is shown in FIG. 6 by a line VI.

In the case where the measured flow rate changes about the flow rate $F_{GC}$, the valve 24 is not actuated and remains in the same state as long as the flow rate remains within the region which is defined by the flow rates $F_{GC1}$ and $F_{GC2}$ which are respectively determined by the voltages $V_{HC}$ and $-V_{HC}$. When the flow rate decreases below the flow rate $F_{GC1}$ or increases above the flow rate $F_{GC2}$, the comparator 40 or 42 produces a signal to actuate the valve 24 so as to correct the flow rate. Thus, the flow rate is controlled to remain within the region which is defined by the flow rates $F_{GC1}$ and $F_{GC2}$. In this case, non-corrected flow rate regions 55*a* and 55*b* have a width which is wider than the width of the above mentioned regions 53*a* and 53*b*. Hence, the flow rate of the fluid flowing through the pipe 13 is controlled with a precision corresponding to the preset flow rate, without causing the problem of hunting.

As may be understood from the description given heretofore, the width of the non-corrected flow rate region is changed proportionally to the valve opening degree of the valve 16. In other words, the width of the non-corrected flow rate region is changed so that the ratio of the width of the non-corrected flow rate region and, the preset flow rate is maintained constant. For this reason, the flow rate can be controlled stably and with an optimum precision for each of the preset flow rates ranging from the small flow rate to the large flow rate, without introducing the problem of hunting.

Further, the present invention is not limited to these embodiments, but various variations and modifications may be made without departing from the scope of the present invention.

What is claimed is:

1. An air fuel ratio control system comprising;

a first control valve provided in a fuel supplying pipe through which a fuel is supplied to a burner;

a second control valve provided in an air supplying pipe through which air is supplied to said burner;

varying means for varying responsive to a preset flow rate of fuel a valve opening degree of each of said first and second control valves while maintaining a constant ratio between the valve opening degrees of said first and second control valves, so that an air fuel ratio of a flow rate of fuel flowing through said first control valve and a flow rate of air flowing through said second control valve assumes a value greater than a theoretical air fuel ratio;

a first flow rate sensor for detecting a flow rate of fuel flowing through said fuel supplying pipe;

a second flow rate sensor for detecting a flow rate of air flowing through said air supplying pipe;

a fuel bypass pipe provided in said fuel supplying pipe for bypassing said first control valve;

a third control valve provided in said fuel bypass pipe; and control means supplied with output signals of said first and second flow rate sensors for controlling a valve opening ratio of said third control valve, so that said air fuel ratio assumes a predetermined air fuel ratio.

2. An air fuel ratio control system as claimed in claim 1 in which said control means comprises a motor which rotates in forward and reverse directions to open and close said third control valve, a differential amplifier applied with the output signals of said first and second flow rate sensors, an air fuel ratio presetting part for correcting the output signal of said first flow rate sensor so that an output voltage of the differential amplifier becomes zero when the air fuel ratio is an theoretical air fuel ratio with regard to the combustion efficiency, and a circuit part for producing a signal for rotating said motor in the forward or reverse direction in response to the output voltage of said differential amplifier.

3. An air fuel ratio control system as claimed in claim 2 in which said control means further comprises a bias applying part for applying a predetermined bias to the output signal of said first or second flow rate sensor, and said control means controls the air fuel ratio to an air fuel ratio in which excess air or excess fuel exists with respect to the theoretical air fuel ratio with regard to the combustion efficiency.

4. An air fuel ratio control system as claimed in claim 3 in which said bias applying part comprises a bias setting part for setting a bias, and a switch provided on an output side of said bias setting part for selectively switching between a mode in which the bias is applied to the output signal of said first or second flow rate sensor and a mode in which the bias is applied to neither of the output signals of said first and second flow rate sensors.

5. An air fuel ratio control system as claimed in claim 1 in which said first control valve and said third control valve are arranged so that 70 to 80 percent of the total fuel flows through said first control valve and 20 to 30 percent of the total fuel flows through said third control valve.

6. An air fuel ratio control system as claimed in claim 2 in which said circuit part comprises a first comparator supplied directly with the output voltage of said differential amplifier to an non-inverting input terminal thereof, a second comparator supplied with the output voltage of said differential amplifier to a non-inverting input terminal thereof through an inverter, and a dead zone presetting circuit for supplying a voltage which corresponds to a dead zone to an inverting input terminal of each of said first and second comparators, said first and second comparators supplying a signal for rotating said motor in the reverse or forward direction when the output voltage of said differential amplifier becomes lower than a lower limit of the dead zone or becomes higher than an upper limit of the dead zone.

7. An air fuel ratio control system as claimed in claim 6 in which said circuit part further comprises a potentiometer provided on said first control valve for producing a voltage dependent on the valve opening degree of said first control valve, said dead zone presetting circuit is supplied with the output voltage of said potentiometer, and said dead zone presetting circuit produces a voltage which corresponds to a wide dead zone when the valve opening degree of said first control valve is large and produces a voltage which corresponds to a narrow dead zone when the valve opening degree of said first control valve is small.

8. An air fuel ratio control system as claimed in claim 1 in which said fuel bypass pipe is provided with a shut-off valve which closes when an abnormality occurs.

* * * * *